United States Patent [19]

Burger

[11] 4,099,622

[45] Jul. 11, 1978

[54] INCLINED CONVEYOR BELT SOLIDS SEPARATION SYSTEM

[75] Inventor: Edward D. Burger, Plano, Tex.

[73] Assignee: Atlantic Richfield Company, Los Angeles, Calif.

[21] Appl. No.: 749,587

[22] Filed: Dec. 10, 1976

[51] Int. Cl.[2] ..... B07C 1/00

[52] U.S. Cl. ..... 209/114

[58] Field of Search ..... 209/114, 116

[56] References Cited

U.S. PATENT DOCUMENTS

| | | | |
|---|---|---|---|
| 661,802 | 11/1900 | Hilleary, Jr. | 209/114 |
| 1,140,236 | 5/1915 | Ayres | 209/117 |
| 1,404,363 | 1/1922 | Grimsrud et al. | 209/114 |
| 2,318,976 | 5/1943 | Stevens | 209/114 |

*Primary Examiner*—Allen N. Knowles

*Attorney, Agent, or Firm*—M. David Folzenlogen

[57] ABSTRACT

Spherically-shaped rolling solids are separated from irregularly-shaped nonrolling solids with an inclined conveyor belt separating system. A dry mixture of the solids is fed onto a section of a continuously upward moving, appropriately inclined conveyor belt. Most of the nonrolling solids eventually move up with the belt and are then moved in a sideways, upward direction or directions off a side of the belt. Most of the rolling solids move down the belt and are then moved in a sideways, downward direction or directions off a side of the belt. These changes in direction of movment of the rolling and nonrolling solids provide several advantages, including the freeing of trapped solids of the other class so that the freed solids may move up or down the belt as the case may be. The solids feed stream and the direction and rate of flow of the solids of the belt may be additionally controlled. The upper surface of the conveyor belt may also be divided into two or more distinct separating sections. In this manner, the separating efficiency and surface utilization of a continuously restored, conveyor belt separating system is increased, while carry-over or loss of desirable solids is reduced. The separating system is especially useful for separating spherical solid heat carriers from spent shale solids in an oil shale retorting facility.

47 Claims, 3 Drawing Figures

INCLINED CONVEYOR BELT SOLIDS SEPARATION SYSTEM

BACKGROUND OF THE INVENTION

This invention pertains to control of the flow of solids onto or off a dry, inclined conveyor belt type solids separating system, which control increases the separating efficiency and surface area utilization of the conveyor belt. The separating system is for separating spherically-shaped rolling solids from irregularly-shaped nonrolling solids and is especially useful for oil shale retorting processes using spherically-shaped solid heat carriers which are recycled through the retorting process.

It is sometimes necessary to separate spherically-shaped rolling solids from irregularly-shaped nonrolling solids. This invention relates to apparatus and methods for carrying out such separation. The system of this invention is especially useful when a dry, high temperature, high capacity, confined system with controlled atmospheric emissions is required, for example, separating spherical solid heat carriers from spent shale in an oil shale retorting process. It is desirable that the separation efficiency be good while carry-over, loss, or attrition of the desired solids, e.g., heat carriers, is low. Yet, these objectives are difficult to achieve, especially when the two classes of solids have overlapping size ranges with relatively similar specific gravities or have overlapping particle weights. It is also desirable that the separating system be relatively compact and have relatively few moving parts in light of the mass of solids to be separated per unit time. A high capacity system with a high degree of adaptability to varying mass flow rates and solids mixtures is highly desired.

Copending Applications Ser. No. 749,505, filed Dec. 10, 1976, entitled "Separation and Recovery of Heat Carriers in an Oil Shale Retorting Process", and Ser. No. 749,504, filed Dec. 10, 1976, entitled "Double Inclined and Stacked Conveyor Belt Solids Separation System", which are owned by a common assignee and are incorporated herein, cover embodiments of a continuously restored inclined surface separating system, which embodiments are especially useful for separating spherical solid heat carriers from spent shale solids in an oil shale retorting process.

One of the embodiments of Application Ser. No. 749,505 covers a continuously restored, inclined conveyor belt solids separation system of the type provided herein. In a system of this type, a mixture of rolling solids and nonrolling solids is fed onto the upper surface of a moving conveyor belt inclined along its longitudinal axis. When the solids impact the surface of the belt, their momentum tends to cause them to initially move up or down the belt. Application Ser. No. 749,504 covers the vertical stacking of conveyor belt separators and a double inclined conveyor belt wherein the belt is inclined both sideways and upward in relation to its longitudinal axis. In this latter system, the momentum of the solids fed onto the belt is up an incline or inclines of the belt so that the solids initially move up an incline.

In both conveyor belt systems, the initial momentum of the solids decreases the effective separating surface area of the belt and tend to aggravate interaction between the solids which creates solids bridging or trapping problems where one type of solid is trapped by moving particles of the other type. This decreases the separation efficiency of the system and increases carry-over or loss of the desired solids.

In both systems, the surface of the inclined conveyor belt is continuously moved upward past the solids feed point and the irregularly-shaped, nonrolling solids move upwardly with the belt until they are removed from the belt either by falling off the end of the belt or until they are pushed off the belt. The spherically-shaped, rolling solids roll down either toward the end of the belt or toward the side of the belt until they are removed from the belt either by falling off the end or side of the belt or until they are pushed off the belt. In either case, when a group of solids has a relatively unimpeded path it may follow in leaving the belt or the group of solids is pushed off the belt in an uncontrolled manner, the group of solids will carry solids of the other class off the belt. Carryover decreases separation efficiency or increases loss of desirable solids, whichever the case may be.

This invention provides several improvements in the inclined conveyor belt system which increases utilization of the surface of an inclined conveyor belt separating system and increases separation efficiency while reducing carry-over or loss of the desired solids.

SUMMARY OF THE INVENTION

Solids are separated by shape or roll factor on the elongated upper surface of an appropriately inclined conveyor belt. The conveyor belt is inclined from horizontal along its longitudinal axis at an angle which is at least as great as the static roll angle of one of the spherically-shaped rolling solids and less than the static slide angle of one of the irregularly-shaped, nonrolling solids. The upper surface of the belt moves upward from the lower end to the upper end of the conveyor belt and provides a continuously restored moving surface for separation of a mixture of solids fed onto the belt.

This invention provides several embodiments of a continuously restored moving inclined conveyor belt separating system which provide for improvements in the system that progressively accomplish several advantages. The improvements allow the conveyor belt to be divided longitudinally into two or more distinct separating sections, thereby increasing the efficiency and compactness of the separating system and reducing the number of parts required per unit mass flow rate of the solids. The improvements reduce the chances that solids of one group will be trapped by solids of the other group, provide control over rapid channeling of the solids off the belt, and increase the chances that solids trapped by one group will be freed and not carried over with the wrong solids, thereby increasing the separating efficiency of the belt and reducing loss of desired solids. These improvements are accomplished without flooding the belt.

On the belt, most of the nonrolling solids eventually move up the belt while most of the rolling solids roll down the belt. At two preselected points spaced longitudinally up and down the belt from the feed point, the movement of the solids is controlled in ways which accomplish the aforementioned advantages. At one of the preselected points which is spaced longitudinally up the belt from the feed point, the upward movement of the nonrolling solids is slowed and the nonrolling solids are moved in a sideways, upward direction or directions to a side of the conveyor belt where the nonrolling solids are removed or fall from the belt. To reduce channeling, a portion of nonrolling solids may be deflected upward toward the center of the belt until they are moved sideways toward the side of the belt. At the second of the preselected points which is spaced longitudinally downward from the feed point, the downward speed of the spherically-shaped rolling solids is slowed and these solids are moved in a downward, sideways direction or directions to a side of the belt where the rolling solids are removed or fall from the belt. To reduce channeling and increase separation efficiency, a portion of the rolling solids may be deflected toward the center of the belt until they are moved sideways toward the side of the belt.

The degree of effectiveness of these improvements is increased by controlling the rate of removal of the solids and holding at least two rows of spherically-shaped solids on the belt, and even further by limiting the amount of spherically-shaped solids held on the belt so that the belt is not flooded with solids. The conveyor belt may also be inclined from horizontal by an angle which is at least as great as the static slide angle of a spherically-shaped rolling solid.

The initial trapping and channeling tendency of the solids is reduced by controlling the impact momentum and initial tendency of the solids to move in a predetermined direction on the belt.

DETAILED DESCRIPTION

Figure 1:
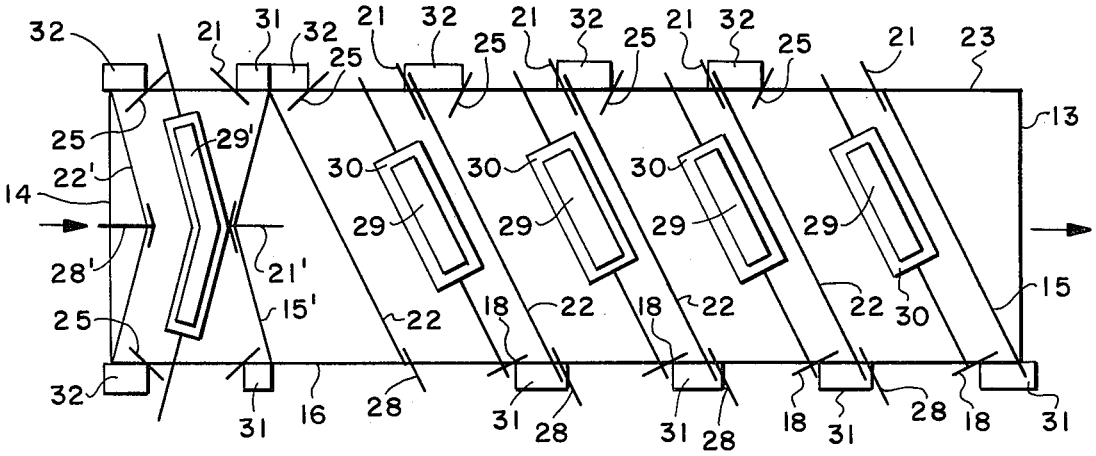
FIG. 1 is a schematical, diagrammatical top plan view of multiple section moving inclined conveyor belt separating system.

As previously noted, this invention relates to an appropriately inclined conveyor belt system for separating solids according to differences in roll factor, that is, by the difference in rate of movement on an inclined surface. The solids may be divided into two groups. One group is sufficiently spherically-shaped to roll down the inclined upper surface of the conveyor belt. Generally, the sphericity factor of the spherically-shaped solids, for the most part, will be at least 0.9, that is, 0.9 or greater. The sphericity factor of these rolling solids is the external or geometric surface area of a sphere having the same volume as the spherically-shaped solid divided by the external surface area of the spherically-shaped solid. The other group of solids is sufficiently irregularly-shaped, laminar-like, flat, or rough, to have one or more sides which tend to cause the irregularly-shaped solid to not roll down the upper inclined surface of the conveyor belt and to come to rest on, or at most, slide down the belt. For purposes of this description, it is assumed that the spherically-shaped solids are the desired solids and that the relative concentration of spherical solids in the mixture is greater than the concentration of irregularly-shaped solids in the mixture.

When a mixture of the two groups of solids is fed onto the inclined upper surface of an upward moving conveyor belt, most of the spherically-shaped solids roll down the inclined belt and most of the irregularly-shaped solids come to rest on the belt and move up with the belt. The belt is inclined from horizontal along its longitudinal axis. The angle is such that it is at least as great as the static roll angle of the desired size spherically-shaped solids and less than the static slide angle of the equal size irregularly-shaped solids. For purposes of this invention, there are three other angles of inclination that should be mentioned. These are the static and dynamic slide angles of the spherically-shaped solids and the dynamic slide angle of the irregularly-shaped solids. These angles are all determined when the conveyor belt is not moving. The static roll angle of the spherically-shaped solids is determined by holding several approximately median size, rolling solids at rest on the conveyor belt at a point on the belt where the solids are to be fed onto the belt, and releasing them to determine the minimum angle at which they will roll down the conveyor belt when released. The static slide angle of the irregularly-shaped solids is determined by holding several irregularly-shaped solids having a size approximately equal to the median size rolling solids at rest on a flat side on the conveyor belt at a point on the belt where the solids are to be fed onto the belt and releasing the irregularly-shaped solids to determine the minimum angle at which they will slide down the conveyor belt when released. The dynamic slide angle of the irregularly-shaped solids is determined by use of the same size nonrolling solids and tapping the solids until they start sliding and determining the minimum angle at which such tapped solids will continue to slide down the surface of the belt. The dynamic slide angle of the irregularly-shaped solids is less than their static slide angle. The static slide angle of the spherically-shaped solids is determined by connecting the centers of three median size rolling solids together in an equilateral triangular arrangement with a solid particle at each corner of the triangle. In this manner, there will be three connected spherically-shaped solids tangentially touching the conveyor at only three points. Thereafter, the angle of the belt is adjusted until the minimum angle at which the static connected solids will start to slide and continue to slide down the surface is determined. The dynamic angle of slide of the spherically-shaped solids is determined with the same connected solids and angle adjustment except that the connected three solids are tapped to start them sliding and the minimum angle at which they continue to slide is determined. The static slide angle of the spherically-shaped solids is greater than the dynamic slide angle of the spherically-shaped solids, but is less than the static slide angle of the irregularly-shaped solids. These angles inherently take into consideration the smoothness of the belt and will be determined at normal room temperatures, e.g., 24° C (75° F). Nevertheless, if the system is to be operated at high temperatures, e.g., as encountered in an oil shale retorting process, it is preferred that these angles be measured at the expected operating temperatures.

The preferred features of the inclined conveyor belt separating system will now be described in detail by having reference to FIGS. 1 through 3, which show conveyor belt-like member 11 having upper surface 12, upper end 13, and lower end 14. The conveyor belt is taut and uniform. It is made of relatively smooth material and if high separating temperatures are to be present, it will usually be made of stainless steel.

Figure 3:
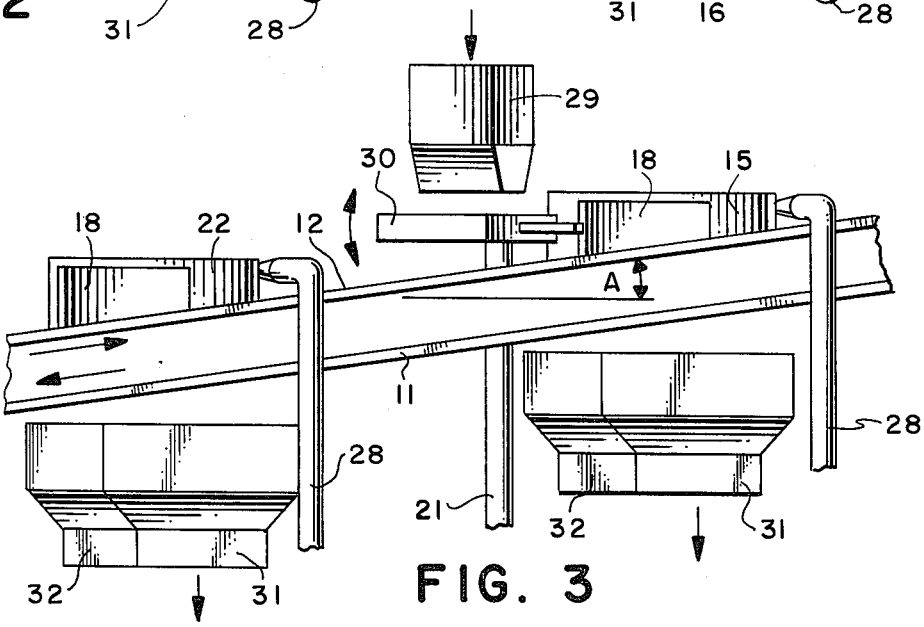
FIG. 3 is a side view of the section of FIG. 2.

The conveyor belt and its upper surface are inclined from horizontal by angle A, as shown in FIG. 3, which is at least as great as, that is, equal to or larger than, the static roll angle of the spherically-shaped solids to be separated from irregularly-shaped solids when a mixture of the solids is fed onto the belt. The angle of inclination of the belt is less than the static slide angle of the irregularly-shaped solids. These angles have been previously defined. The efficiency and flexibility of the system, especially the rate of movement of the belt, are significantly increased if the angle of inclination A is at least as great as the static slide angle of the spherically-shaped solids. At this angle, the spherically-shaped solids cannot move up the belt unless they are trapped by irregularly-shaped solids.

Upper end 13 is, therefore, at a higher elevation than lower end 14 and the belt is adapted in the usual fashion of a conveyor belt to rotate about its ends. A point on the upper surface of the belt moves upward to and around the upper end of the belt, back downward around the lower end, and back upward to the point of origination. The speed of the belt will be adjusted to suit the other conditions of the separating system including the rate of feed of the solids.

The inclined, upper surface of the belt may be divided into at least two distinct separating sections or areas. As shown, the belt is divided into five sections. Dividing the belt into more than one section enables the belt to handle appreciably more solids per unit surface area.

Figure 2:
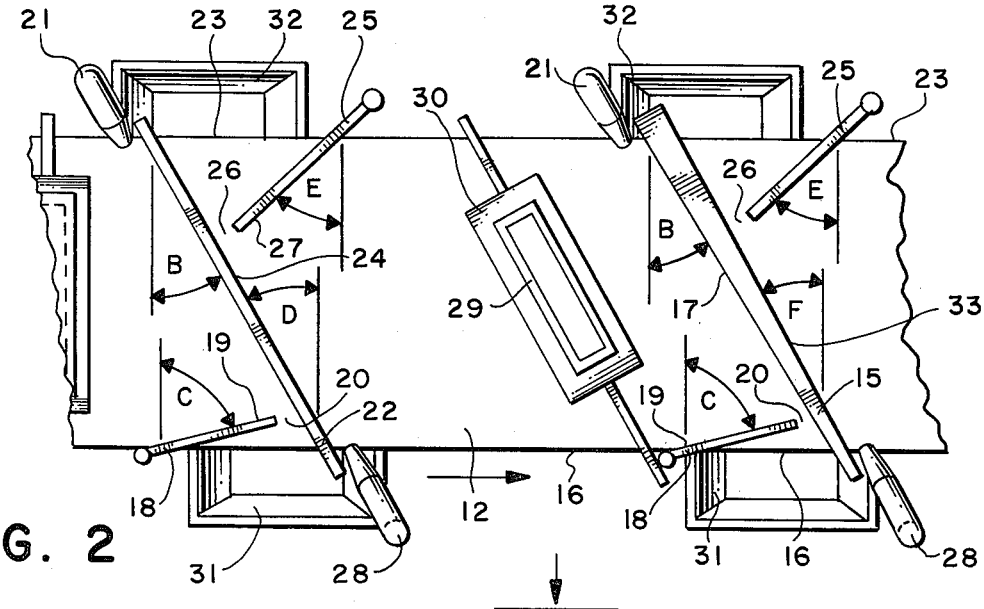
FIG. 2 is a fragmented top plan view of a distinct separating section of the moving inclined conveyor belt separating system.

Each section of the belt has similar features which are better shown in FIGS. 2 and 3. At a preselected elevation or first removal point or area on the belt, the separating system has first removal means 15 which is adapted to deflect or move irregularly-shaped nonrolling solids moving upward on upper surface 12 in an upward, sideways direction so that the nonrolling solids move off side 16 of the conveyor belt. First removal means 15 may be any sort of system, for example, a scraper, brush, or gas jet, for cooperating with movement of the belt and for deflecting nonrolling solids off the belt. As shown, first removal means 15 is a scraper blade which has lower side 17 which diagonally crosses upper surface 12 at angle B with respect to the width of the belt so that lower side 17 slopes upward and sideways with respect to the longitudinal axis of the belt. The lower edge of the blade is parallel to and fits flat on upper surface 12. The angle B is appropriately selected to slow and control the rate of upward and sideways movement of the irregularly-shaped solids toward the side of the belt and to cooperate with other sections of the belt and provide the best effective separating surface area per section. The slowing and changing of the direction of movement of the nonrolling solids enables the belt to be divided into two or more distinct separating sections and tends to free trapped rolling solids and reduce solids channeling off the belt, thereby increasing separation efficiency and reducing loss or carry-over of spherically-shaped solids.

The effectiveness of removal means 15 is affected by several operating conditions of the separating system especially the degree of solids saturation on the belt. At both high and low saturations, it is best to provide for additional control over the nonrolling solids. First control means 18 is adapted to coact with first removal means 15 and control the rate of movement of the irregularly-shaped solids deflected toward and off side 16 by the scraper. First control means 18 is also adapted to deflect a portion of the irregularly-shaped solids moving upward on upper surface 12 in an upward, sideways direction away from side 16 of the conveyor belt and toward lower side 17 of removal means 15. As shown, first control means 18 is a scraper which has inner side 19. The control scraper is pivotally and adjustably mounted to control opening 20 between lower side 17 and the end of the control means and to change angle C with respect to the width of the belt. This first control means could be operated manually or automatically and appropriate sensors could be provided for detecting rate of solids movement, saturation and build up near the first removal point.

If conditions warrant, auxiliary control means 21 of the type hereinafter described could be provided. The auxiliary control means is like the lower third control means hereinafter described and would be adapted to increase the rate of movement of the irregularly-shaped solids off side 16 of the conveyor belt. As previously mentioned, for purposes of this description, it is assumed that the relative concentration of nonrolling solids is substantially less than the concentration of rolling solids in the mixture of solids to be separated and auxiliary control means 21 is not normally required.

At a second preselected point or area on upper surface 12 which point is spaced along the longitudinal axis of conveyor belt-like member 11 away from and at an elevation below first removal means 15 is second removal means 22. The second removal means is adapted to deflect or move spherically-shaped rolling solids moving downward on upper surface 12 in a downward, sideways direction so that the rolling solids move off side 23 of the conveyor belt. Removal means 22 may be any sort of system for cooperating with the rolling movement of the spherically-shaped solids and for deflecting such solids in the proper direction off the belt. As shown, second removal means 22 is a scraper blade which has upper side 24 which diagonally crosses upper surface 12 at angle D with respect to the width of the conveyor belt so that upper side 24 slopes downward and sideways with respect to the longitudinal axis of the conveyor belt-like member. The lower edge of the scraper blade is parallel to and fits flat on upper surface 12. The angle D is appropriately selected to slow and control the rate of downward and sideways movement of the spherically-shaped solids. This slowing and changing of the direction of movement of the rolling solids enables the belt to be divided into two or more distinct separating sections, reduces rapid solids channeling off the belt, and increases the chances that trapped nonrolling solids will come to rest on upper surface 12 and move back upward with the belt to first removal means 15. This increases separation efficiency.

Usually the spherically-shaped solids will be present in greater numbers than the nonrolling solids and it is much more difficult to control the rate of movement and trapping tendencies of the spherically-shaped solids. A large portion of the nonrolling solids is likely to be trapped by particle interaction with the rapidly rolling spherically-shaped solids. Consequently, second control means 25 is almost a necessity except at very low solids feed rates. Second control means 25 is adapted to coact with second removal means 22 and control the rate of movement of the spherically-shaped solids deflected or moved off the conveyor belt by the second removal means. An important feature of second control means 25 is that it is adapted to coact with second removal means 22 and to hold at least two rows of spherically-shaped solids on upper surface 12 adjacent second removal means 22. By holding two or more side-by-side rows of spherically-shaped solids on the belt, rapid channeling of the solids off the belt is prevented and it is practically assured that trapped nonrolling solids will come to rest on the belt. Since the angle of the belt is below the static slide angle of the irregularly-shaped solids, these nonrolling solids will grab the belt and move back up the belt on upper surface 12 until they contact first removal means 15 or first control means 18.

As shown, second control means 25 is a scraper which is pivotally and adjustably mounted to control opening 26 between upper side 24 and the end of the scraper and to change angle E with respect to the width of the belt. The second control means could be operated manually or automatically and appropriate sensors would be provided for detecting rate of solids movement, saturation, and build up near the second removal point. Second control means 25 has inner side 27 which is adapted to deflect a portion of the spherically-shaped solids moving down the belt in a downward, sideways direction away from side 23 of the conveyor belt and toward upper side 24 of the second removal means.

When properly in tune, the rate of passage or removal of spherically-shaped solids through opening 26 will equal the rate of arrival of rolling solids against the spherically-shaped solids held adjacent the second removal means on upper surface 12 of the conveyor belt. If this balance is lost, the rolling solids may channel and carry nonrolling solids off the belt or the build up of spherically-shaped solids will increase to the point that the effective surface area is substantially reduced or a vertical monolayer of solids is not maintained. It is difficult to maintain this balance with only the second control means; therefore, third control means 28 is provided. The third control means is adapted to increase the rate of movement of the spherically-shaped solids through opening 26 and off side 23 of conveyor belt 11. The third control means could be any sort of system for accelerating or pushing solids through the opening. As shown, the control means is an appropriately aimed gas jet which could be controlled manually or automatically by appropriate sensors in the same way that second control means 25 is controlled.

The belt area lying between first removal means 15 and second removal means 22 provides sufficient surface area for separation of a mixture of solids according to roll factor and for handling the necessary mass flow of solids. At a preselected point between the two removal means is supply means 29 which is located above a portion of upper surface 12 and is adapted to feed a mixture of spherically-shaped solids and irregularly-shaped solids onto a moving impingement area portion of upper surface 12. Supply means 29 is any sort of system, e.g., one or more chutes or passages, for feeding a mixture of solids onto upper surface 12. Preferably, supply means 29 will be adapted, as shown, to feed solids in a way such that the effective separating surface distances between the feed system and each removal means will be preserved. In other words, the supply means will distribute solids in a pattern that is parallel to the lower or second removal means. Moving solids have momentum and tend to initially move up or down the upper surface of the conveyor belt. This tends to reduce the effective separating surface area of the belt and to cause one group of solids to initially trap solids from the other group. The extent of these problems may be reduced by adapting the supply means to reduce the impact momentum of the solids on upper surface 12 and by further adapting the supply means to control the initial tendency of the solids to move in a predetermined direction on upper surface 12. The predetermined direction will depend on the angle of inclination of the conveyor belt, the rate of movement of upper surface 12, the solids feed rate, the relative concentrations of the solids, and the solids saturation on upper surface 12. The objective is to minimize trapping of other solids and increase separating efficiency. As illustrated, the supply means has pivotal deflector plate 30 which slows the rate of movement of the solids just prior to their impacting upper surface 12 of the conveyor belt. The deflector plate is pivoted to provide the proper angle and direction of feed of the mixture of solids to at least partially control the initial tendency of the impacting solids to move in the desired direction.

At each removal point, there is means for receiving solids falling off a side of the conveyor belt. As shown, first receiving means 31 is adapted to receive irregularly-shaped solids deflected off side 16 of conveyor belt-like member 11 by first removal means 15. Second receiving means 32 is adapted to receive spherically-shaped solids deflected off side 23 of the conveyor belt by second removal means 22. The receiving means are any sort of system, e.g., one or more troughs, catchers, or chutes, for receiving and collecting solids.

As previously mentioned, the efficiency and compactness of the conveyor belt separating system is enhanced if upper surface 12 of the conveyor belt-like member is divided along its longitudinal axis into two or more distinct separating sections with a first removal means at the upper end of each section and a second removal means at the lower end of each section. There will also be a supply means for each section and receiving means for the separated solids.

The features described above for each section are especially suited to multiple section conveyor belt separating system. Moreover, as shown, each section may be separated by a removal means which has an upper side and a lower side. Contiguous sections will lie in progressively higher elevations up the belt. The upper side of a removal means may act as the second removal means for deflecting spherically-shaped solids from the belt. The lower side of a removal means may act as the first removal means for deflecting irregularly-shaped solids from the belt. For illustrative purposes only, first removal means 15 has upper 33 which is at angle F with respect to width of the conveyor belt while lower side 17 of first removal means 15 is at angle B. This is included to simply illustrate the fact that the upper and lower sides of a removal means do not need to be fixed or parallel and the angle of removal of the rolling solids may be different from the angle of removal of the nonrolling solids.

In the drawing, it is also to be noted that first removal means 15 moves irregularly-shaped solids toward side 16 and that second removal means 22 moves spherically-shaped solids toward side 23. Actually the pair of removal means could be made to move their respective solids toward the same side of the conveyor belt, but it is much preferred that removal means move their respective solids toward opposite sides of the belt, especially if the belt is divided into two or more distinct separating areas. This would save space on the belt and facilitate collection of each group of solids through a common receiving system and reduce the number of pieces of equipment that would need to be fabricated.

In addition, as indicated in FIG. 1, first removal means 15', second removal means 22', auxiliary control means 21', third control means 28', and supply means 29' could be adapted to split their respective solids and move solids to both sides of the conveyor belt-like member. But as illustrated, this is not efficient use of the surface area of the belt and of other components of the system. This might be useful in a very wide belt situation where the diagonal distances would otherwise be excessive.

During operation, upper surface 12 of the conveyor belt is inclined from horizontal at an angle at least as great as the static roll angle of the spherically-shaped solids, and more preferably at least as great as the static slide angle of the spherically-shaped solids, and at an angle which is less than the static slide angle of the irregularly-shaped solids, and more preferably, less than the dynamic slide angle of these nonrolling solids. The upper surface is moved continuously upward around upper end 13 and downward and around lower end 14 past one or more feed points at supply means 29. This movement provides a continuously restored impingement area for receipt of solids. The impingement area will be clear of solids except for previously trapped solids moving up or down on the belt after being freed.

A mixture of spherically-shaped solids and irregularly-shaped solids is fed at one or more supply or feed points onto one or more initial impingement areas of upper surface 12. The rate of movement of the solids being fed onto the inclined surface of the belt may be slowed just prior to impact with the surface, thereby reducing the impact momentum that the solids would have had had they not been slowed. Moreover, the direction of movement of the solids may be adjusted by deflector plate 30 to control the initial tendency of the solids to move up or down the conveyor belt or to essentially have no initial tendency to move in either direction. Reducing impact momentum and controlling initial movement of the solids will increase the separating efficiency and reduce the trapping of solids of the other class.

The angle of inclination of the belt and the rate of feed of the mixture of solids maintain a monolayer of spherically-shaped solids on upper surface 12. The word "monolayer" refers to a single layer of rolling solids with respect to vertical or an axis perpendicular to upper surface 12. In other words, the solids do not stack one on top of the other. A monolayer is necessary to proper operation of an inclined conveyor belt separating system of the type described herein because it is assumed that the relative concentrations of the rolling solids is equal to or greater than the concentration of the nonrolling solids. At these relative concentrations, a relatively large percentage of the irregulary-shaped solids will be trapped by the spherically-shaped solids and move down the belt until the rate of downward movement of the solids is decreased or the irregularly-shaped solids come to rest. In order to move back up with the belt, the irregularly-shaped solids must grab upper surface 12. If the solids were not maintained in a monolayer, the irregularly-shaped solids could not grab the upper surface of the conveyor belt.

After the mixture impacts the upper surface of the belt, the spherically-shaped solids are allowed to roll down upper surface 12. Since the relative concentration of the spherically-shaped solids is relatively high, most of the spherically-shaped solids will rapidly roll down the belt. Some shperically-shaped solids may be trapped by upwardly moving irregularly-shaped solids. These trapped rolling solids will be mentioned again.

The spherically-shaped solids rolling down the belt will normally trap some irregularly-shaped solids. At a preselected point or area of the conveyor belt, downward moving solids come under the influence of second removal means 22 either by contacting the removal means or by contacting other solids which are adjacent the removal means. At the second removal area, the downward speed of the spherically-shaped solids is slowed and the spherically-shaped solids are moved in a downward, sideways direction at an angle with respect to the longitudinal axis of the conveyor belt so that the spherically-shaped solids move to a side of the conveyor belt where they are removed from the belt. Slowing the downward movement of the rolling solids and changing their direction of movement tends to free the irregularly-shaped solids or allow them to come to rest on moving upper surface 12. These freed or resting irregularly-shaped solids migrate upward with upper surface 12 because the angle of inclination of the conveyor belt is less than the static slide angle, and preferably less than the dynamic slide angle, of the nonrolling solids,, because there is less channeling of spherically-shaped solids off the conveyor belt, and because there is less interaction and chances of interaction between a resting solid moving up the belt than there was initially when the mixture was fed onto the conveyor belt.

In many and perhaps most cases, the feed rate of the solids will be such that spherically-shaped solids will tend to build up in side-by-side relationship near the higher elevation side of second removal means 22 or the side of the belt opposite the exit side. In effect, this decreases the effective width of the belt and changes the rate and angle of solids movement or channeling. This would decrease the freeing of trapped irregularly-shaped solids and decrease separation efficiency. These effects are at least partially overcome by controlling the rate of movement of spherically-shaped solids off the conveyor belt at the second removal point or area and by moving a portion of these solids near the exit side of the belt in a downward, sideways direction away from the side of the conveyor belt toward the center of the belt before these solids are moved by second removal means 22 off the side of the conveyor belt.

The separation efficiency is significantly increased at normal solids feed rates if at least two rows of spherically-shaped solids are maintained on upper surface 12 at the second removal point or area. These rows are in side-by-side relationship. By maintaining two or more rows of spherically-shaped solids in a monolayer, trapped irregularly-shaped solids are almost sure to come to rest on moving upper surface 12 where they will will migrate upward on the belt back past the feed point to first removal means 15.

Optimum operation of the separating system will occur when the rate of removal of the spherically-shaped solids from the conveyor belt is equal to the rate of arrival of the spherically-shaped solids against the rows of solids maintained on the belt. But this condition is difficult to maintain under all conditions. If the rate of arrival of the spherically-shaped solids exceeds the rate of removal, rows of solids will build up toward the feed point thereby flooding the conveyor belt. Second control means 25 partially compensates for this build up and increases the rate of removal of the spherically-shaped solids. But reactive time or degree of compensation provided by this second control means may not be enough. These potential shortcomings are relieved by third removal means 28 which emits a properly directed jet of gas which pushes against the first one or two rows of spherically-shaped solids adjacent second removal means 22 and accelerates the rate of removal of the spherically-shaped solids through opening 26.

In the above described manner, most of the trapped irregularly-shaped solids are freed to move upward with the belt and most of these nonrolling solids eventually wind up moving up the belt to one or more first removal points or areas.

At the first removal point, the direction of upward movement of the irregularly-shaped solids is changed and these nonrolling solids are moved upward and sideways at an angle with respect to the longitudinal axis of the conveyor belt so that the irregularly-shaped solids move toward the side of the conveyor belt where they are removed from the belt. This allows the belt to be divided into distinct separating sections and allows trapped spherically-shaped solids to roll free and move down the belt, thereby reducing carry-over of the desired spherically-shaped solids.

Channeling and the rate of movement of the irregularly-shaped nonrolling solids off the conveyor belt is controlled by the coaction of first removal means 15 and first control means 18. The diagonal angle of the first removal means affects the rate of removal of the irregularly-shaped solids. The first control means controls the exit opening between it and the scraper blade of the first removal means and deflects the upward movement of a portion of the irregularly-shaped solids in an upward, sideways direction away from side 16 of the conveyor belt before this portion of the solids is moved upward and sideways by first removal means 18. This further increases the probability that trapped rolling solids, if any, will be released and prevents surge losses of unseparated solids.

The volumes and relative amounts and sizes of the solids in the mixture will affect the overall design of the separating system. The spherically-shaped solids are usually the desired solids and are normally in a relatively narrow size range when compared to the irregularly-shaped solids. The inclined conveyor belt system is especially suited to spherically-shaped solids in having a size above 0.14 centimeter (0.055 inch). The separating system performs best when a significant portion or all of the larger size and smaller size irregularly-shaped solids, especially fine size solids, are removed prior to using the inclined conveyor belt separating system. Fortunately, it is usually relatively easy to separate and remove a significant portion of the irregularly-shaped or fine size undesired solids.

If there is an appreciable amount of irregularly-shaped solids which are larger than the spherically-shaped solids and the volumes to be handled justify it, it would be best to first process the mixture to separate at least a portion of the larger irregularly-shaped solids prior to using the inclined conveyor belt system. The larger size irregularly-shaped solids may be separated by screening. This initial screening or separation of the larger solids is optional and this step may be delayed until after some of the smaller size irregularly-shaped solids are removed.

By the same token, if the amount of irregularly-shaped solids smaller than the spherically-shaped solids is sufficiently large to warrant it, it would be best to remove at least a portion of the finer irregularly-shaped solids prior to treating the mixture on the inclined surface. Fine size solids greatly affect rolling characteristics and tend to unduly adhere to the separating surface of the conveyor belt. A significant portion, especially fines, of the smaller size irregularly-shaped solids may be removed by screening or by a low velocity elutriating gas. If the system is to be operated at elevated temperatures, it will be desirable to heat the gas used in elutriation. The gas should be a noncombustion supporting gas if there are combustible materials present on the solids.

The separating system of this invention is particularly advantageous for separating spherically-shaped heat carriers from irregularly-shaped spent shale, especially porous pellet heat carriers in a size range of between 0.14 centimeter (0.055 inch) to approximately 1.27 centimeter (0.5 inch) of the type described in U.S. Pat. No. 3,844,929. In oil shale retorting, mined crushed oil shale is mixed with hot, heat-carrying, spherically-shaped solids in a retort. The heat in the hot heat carriers pyrolyzes oil and gas vapors from the oil shale and produces a mixture of spherically-shaped solids and nonrolling spent shale. After retorting, the solids mixture is processed to recover the heat carriers for recycle through the retorting process and for separation and disposal of the spent shale. This separation and recovery of solids is usually accomplished in several stages. One of the separating stages will use the inclined conveyor belt system of this invention. As mentioned in Copending Application Ser. No., the efficiency of this process will be increased if a portion of the irregularly-shaped spent shale solids larger than the heat carriers is removed and if a portion of the irregularly-shaped spent shale solids smaller than the heat carriers is removed prior to processing a mixture of the remaining solids on the inclined conveyor belt system of this invention.

Several preferred embodiments of various features of the invention have been described and illustrated. It is to be understood that the invention is not to be limited to the precise details or features herein illustrated and described since these features and excellent results may be obtained and carried out in a number of other ways falling within the scope of the invention as illustrated and described. For example, multiple section conveyor belts could be vertically stacked as described in Copending Application Ser. No. 749,504 and fed as described and covered therein and herein.

The embodiments of the invention in which an exclusive property or privilege is claimed are defined as follows:

1. A system for separating spherically-shaped solids which tend to roll down an inclined surface from irregularly-shaped solids which have a side that causes the irregularly-shaped solids to tend to slide down an inclined surface comprising:

a. a conveyor belt-like member having an upper surface, an upper end and a lower end and adapted to rotate about said upper end and said lower end in a manner such that a point on said conveyor belt-like member cycles upward around said upper end, downward around said lower end, and then upward to the point of origination, said conveyor belt-like member being inclined from horizontal along its longitudinal axis at an angle at least as great as the static roll angle of the spherically-shaped solids and less than the static slide angle of the irregularly-shaped solids;

b. first removal means adapted to deflect irregularly-shaped solids moving upward on said upper surface in an upward, sideways direction so that said irregularly-shaped solids move off a side of said conveyor belt-like member;

c. second removal means spaced along the longitudinal axis of said conveyor belt-like member from and below said first removal means, said second removal means being adapted to deflect spherically-shaped solids moving downward on said upper surface in a downward, sideways direction so that said spherically-shaped solids move off a side of said conveyor belt-like member;

d. supply means adapted to feed a mixture of said spherically-shaped solids and said irregularly-shaped solids onto a portion of said upper surface between said first removal means and said second removal means;

e. first receiving means adapted to receive irregularly-shaped solids deflected off said inclined conveyor belt-like member by said first removal means; and f. second receiving means adapted to receive spherically-shaped solids deflected off said inclined conveyor belt-like member by said second removal means.

2. The system of claim 1 wherein the supply means is adapted to reduce the impact momentum of the spherically-shaped solids and the irregularly-shaped solids on the upper surface of the conveyor belt-like member.

3. The system of claim 2 wherein said supply means is also adapted to control the initial tendency of said spherically-shaped solids and said irregularly-shaped solids to move in a predetermined direction on said upper surface.

4. The system of claim 1 wherein the upper surface of the conveyor belt-like member is inclined from horizontal along its longitudinal axis at an angle which is at least as great as the static slide angle of said spherically-shaped solids and is less than the static slide angle of said irregularly-shaped solids.

5. The system of claim 1 wherein first control means is adapted to deflect a portion of the irregularly-shaped solids moving upward on the upper surface in an upward, sideways direction away from a side of the conveyor belt-like member toward the first removal means.

6. The system of claim 5 wherein the first control means is adapted to coact with said first removal means and control the rate of movement of said irregularly-shaped solids deflected off said conveyor belt-like member by said first removal means.

7. The system of claim 5 wherein the supply means is adapted to reduce the impact momentum of the spherically-shaped solids and the irregularly-shaped solids on said upper surface of said conveyor belt-like member.

8. The system of claim 7 wherein said supply means is adapted to control the initial tendency of said spherically-shaped solids and said irregularly-shaped solids to move in a predetermined direction on said upper surface.

9. The system of claim 5 wherein said upper surface of said conveyor belt-like member is inclined from horizontal along its longitudinal axis at an angle which is at least as great as the static slide angle of said spherically-shaped solids and is less than the static slide angle of said irregularly-shaped solids.

10. The system of claim 5 wherein second control means is adapted to deflect a portion of the spherically-shaped solids moving downward on said upper surface in a downward, sideways direction away from a side of said conveyor belt-like member toward the second removal means.

11. The system of claim 10 wherein the second control means is adapted to coact with said second removal means and control the rate of movement of the spherically-shaped solids deflected off the conveyor belt-like member by said second removal means and at least two rows of spherically-shaped solids are maintained on said upper surface adjacent said second removal means.

12. The system of claim 10 wherein third control means is adapted to increase the rate of movement of said spherically shaped solids off said conveyor belt-like member.

13. The system of claim 10 wherein the supply means is adapted to reduce the impact momentum of the spherically-shaped solids and the irregularly-shaped solids on said upper surface of said conveyor belt-like member.

14. The system of claim 13 wherein said supply means is adapted to control the initial tendency of said spherically-shaped solids and said irregularly-shaped solids to move in a predetermined direction on said upper surface.

15. The system of claim 10 wherein said upper surface of said conveyor belt-like member is inclined from horizontal along its longitudinal axis at an angle at least as great as the static slide angle of said spherically-shaped solids and is less than the static slide angle of said irregularly-shaped solids.

16. The system of claim 1 wherein second control means is adapted to deflect a portion of the spherically-shaped solids moving downward on the upper surface in a downward, sideways direction away from a side of the conveyor belt-like member toward the second removal means.

17. The system of claim 16 wherein the second control means is adapted to coact with said second removal means and control the rate of movement of the spherically-shaped solids deflected off said conveyor belt-like member by said second removal means and at least two rows of spherically-shaped solids are maintained on said upper surface adjacent said second removal means.

18. The system of claim 16 wherein third control means is adapted to increase the rate of movement of said spherically-shaped solids off said conveyor belt-like member.

19. The system of claim 16 wherein the supply means is adapted to reduce the impact momentum of the spherically-shaped solids and the irregularly-shaped solids on said upper surface of said conveyor belt-like member.

20. The system of claim 19 wherein said supply means is adapted to control the initial tendency of said spherically-shaped solids and said irregularly-shaped solids to move in a predetermined direction on said upper surface.

21. The system of claim 16 wherein said upper surface of said conveyor belt-like member is inclined from horizontal along its longitudinal axis at an angle at least as great as the static slide angle of said spherically-shaped solids and is less than the static slide angle of said irregularly-shaped solids.

22. The system of claim 1 wherein the upper surface of the conveyor belt-like member is divided along its longitudinal axis into at least two sections, a first removal means at the upper end of each of said sections, a second removal means at the lower end of each of said sections, and supply means adapted to feed a mixture of the spherically-shaped solids and the irregularly-shaped solids onto a portion of said upper surface within each of said sections between said first and second removal means.

23. The system of claim 22 wherein each of the supply means is adapted to reduce the impact momentum of the spherically-shaped solids and the irregularly-shaped solids on said upper surface on said conveyor belt-like member.

24. The system of claim 23 wherein each of said supply means is also adapted to control the initial tendency of said spherically-shaped solids and said irregularly-shaped solids to move in a predetermined direction on said upper surface.

25. The system of claim 22 wherein said upper surface of said conveyor belt-like member is inclined from horizontal along its longitudinal axis at an angle at least as great as the static slide angle of said spherically-shaped solids and is less than the static slide angle of said irregularly-shaped solids.

26. The system of claim 22 wherein in each of the sections, first control means is adapted to deflect a portion of the irregularly-shaped solids moving upward on said upper surface in an upward, sideways direction away from a side of said conveyor belt-like member toward said first removal means.

27. The system of claim 26 wherein the first control means in each of said sections is also adapted to coact with said first removal means and control the rate of movement of the irregularly-shaped solids deflected off said conveyor belt-like member by said first removal means.

28. The system of claim 26 wherein in each of said sections, second control means is adapted to deflect a portion of the spherically-shaped solids moving downward on said upper surface in a downward, sideways direction away from a side of said conveyor belt-like member toward said second removal means.

29. The system of claim 28 wherein the second control means is adapted to coact with said second removal means and control the rate of movement of the spherically-shaped solids deflected off said conveyor belt-like member by said second removal means and at least two rows of spherically-shaped solids are maintained on said upper surface each of said second removal means.

30. The system of claim 28 wherein in each of said sections, third control means is adapted to increase the rate of movement of said spherically-shaped solids off said conveyor belt-like member.

31. The system of claim 22 wherein in each of said sections, second control means is adapted to deflect a portion of the spherically-shaped solids moving downward on said upper surface in a downward, sideways direction away from a side of said conveyor belt-like member toward said second removal means.

32. The system of claim 31 wherein the second control means is also adapted to coact with said second removal means and control the rate of movement of the spherically-shaped solids deflected off the conveyor belt-like member by said second removal means and at least two rows of spherically-shaped solids are maintained on said upper surface adjacent each of said second removal means.

33. The system of claim 31 wherein in each of said sections, third control means is adapted to increase the rate of movement of said spherically-shaped solids off said conveyor belt-like member.

34. The system of claim 22 wherein a removal means having an upper side and a lower side separates a first section and a second section of said upper surface of said conveyor belt-like member, said first section being at an elevation higher than said second section, said upper side of said removal means being the second removal means of said first section, and said lower side of said removal means being the first removal means of said second section.

35. A method for separating spherically-shaped solids which tend to roll down an inclined surface from irregularly-shaped solids which tend to slide down an inclined surface comprising:

a. moving an upper inclined surface of an elongated conveyor belt around a lower end of said conveyor belt at a lower elevation past at least one feed point to a higher elevation around an upper end of said conveyor belt, said movement from said lower elevation to said higher elevation being inclined at an angle with respect to horizontal, said angle being at least as great as the static roll angle of said spherically-shaped solids and being below the static slide angle of said irregularly-shaped solids;

b. feeding a mixture of spherically-shaped solids and irregularly-shaped solids at a first feed point onto an initial first impingement area of said upper inclined surface, said first impingement area being constantly changed and restored as said upper inclined surface is moved from said lower elevation past said first feed point to said upper elevation;

c. moving most of said irregularly-shaped solids fed onto said upper inclined surface in a generally longitudinal direction up said upper inclined surface to a first removal point at an elevation higher on said conveyor belt than said first impingement area;

d. changing the direction of upward movement of the irregularly-shaped solids at said first removal point and moving the irregularly-shaped solids at said first removal point in an upward, sideways direction at an angle with respect to the longitudinal axis of said conveyor belt so that said irregularly-shaped solids move toward a side of said conveyor belt;

e. removing irregularly-shaped solids at said first removal point off the side of said conveyor belt;

f. allowing most of said spherically-shaped solids fed onto said upper inclined surface to roll down said upper inclined surface to a second removal point at an elevation lower on said conveyor belt than said first impingement area; the rate of feed of said mixture in step (b) and said angle in step (a) being such that a monolayer of solids with respect to vertical is maintained on said upper inclined surface at said second removal point;

g. slowing the downward speed of the spherically-shaped solids at said second removal point and moving the spherically-shaped solids at said second removal point in a downward, sideways direction at an angle with respect to the longitudinal axis of said conveyor belt so that said spherically-shaped solids move to a side of said conveyor bolt; and h. removing spherically-shaped solids at said second removal point off the side of said conveyor belt.

36. The method according to claim 35 wherein the angle of inclination from horizontal of the conveyor belt is at least as great as the static slide angle of the spherically-shaped solids and is less than the static slide angle of the irregularly-shaped solids.

37. The method according to claim 35 wherein the rate of movement of the solids being fed onto the upper inclined surface in step (b) is slowed prior to impact with said upper inclined surface, thereby reducing the impact momentum that said solids would have had without having been slowed.

38. The method according to claim 35 wherein the rate of movement of the solids being fed onto the upper inclined surface in step (b) is slowed to reduce the impact momentum of said solids and the direction of movement of said solids is adjusted to control the initial tendency of said solids to move in a predetermined direction on the upper surface of the conveyor belt.

39. The method according to claim 35 wherein the direction of upward movement of a portion of the irregularly-shaped solids at said first removal point is changed and said portion of said irregularly-shaped solids is moved in an upward, sideways direction away from the side of the conveyor belt before said portion of said irregularly-shaped solids is moved in step (d) off said side of said conveyor belt.

40. The method according to claim 39 wherein in step (e), the rate of removal of the irregularly-shaped solids off the side of the conveyor belt at the first removal point is controlled.

41. The method according to claim 40 wherein the rate of movement of the solids being fed onto the upper inclined surface in step (b) is slowed to reduce the impact momentum of said solids and the direction of movement of said solids is adjusted to control the initial tendency of said solids to move in a predetermined direction on the upper surface of the conveyor belt.

42. The method according to claim 35 wherein a portion of the spherically-shaped solids moving down the conveyor belt is moved at the second removal point in a downward, sideways direction away from the side of said conveyor belt before said portion of said spherically-shaped solids is moved in step (g) off said side of said conveyor belt.

43. The method according to claim 35 wherein in step (h) the rate of removal of the spherically-shaped solids off the side of the conveyor belt at the second removal point is controlled to maintain at least two rows of said spherically-shaped solids on said upper inclined surface at the second removal point.

44. The method according to claim 43 wherein the rate of removal of said spherically-shaped solids off said side of said conveyor belt at said second removal point is increased whenever the build up of spherically-shaped solids at said second removal point indicates that said build up is likely to interfere with separating efficiency of said method.

45. The method according to claim 43 wherein a portion of the spherically-shaped solids moving down the conveyor belt is moved at the second removal point in a downward, sideways direction away from the side of said conveyor belt before said portion of said spherically-shaped solids is moved in step (g) off said side of said conveyor belt.

46. The method according to claim 43 wherein the rate of movement of the solids being fed onto the upper inclined surface in step (b) is slowed to reduce the impact momentum of said solids and the direction of movement of said solids is adjusted to control the initial tendency of said solids to move in a predetermined direction on the upper surface of the conveyor belt.

47. The method according to claim 35 wherein steps (b) through (h), inclusive, are conducted at at least two separate sections on the conveyor belt.

* * * * *

UNITED STATES PATENT OFFICE

CERTIFICATE OF CORRECTION

PATENT NO. : 4,099,622

DATED : July 11, 1978

INVENTOR(S) : Edward D. Burger

It is certified that error appears in the above-identified patent and that said Letters Patent are hereby corrected as shown below:

In Column 15, line 1, after "surface", the word "on" should read ---of---.

In Column 15, line 38, after "surface", insert the word ---adjacent---.

In Column 16, line 55, after "conveyor", the word "bolt" should read ---belt---.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*